US006858989B2

(12) United States Patent
Howard

(10) Patent No.: US 6,858,989 B2
(45) Date of Patent: Feb. 22, 2005

(54) METHOD AND SYSTEM FOR STABILIZING THIN FILM TRANSISTORS IN AMOLED DISPLAYS

(75) Inventor: Webster E. Howard, Lagrangeville, NY (US)

(73) Assignee: eMagin Corporation, Hopewell Junction, NY (US)

( * ) Notice: Subject to any disclaimer, the term of this patent is extended or adjusted under 35 U.S.C. 154(b) by 151 days.

(21) Appl. No.: 09/957,221

(22) Filed: Sep. 20, 2001

(65) Prior Publication Data

US 2003/0052614 A1 Mar. 20, 2003

(51) Int. Cl.[7] ..... G09G 3/10; G09G 5/00

(52) U.S. Cl. ..... 315/169.1; 315/169.4; 315/169.3; 345/211

(58) Field of Search ..... 315/169.1, 169.2, 315/169.3, 169.4; 345/211, 76, 77, 36, 46, 56, 82, 83, 92

(56) References Cited

U.S. PATENT DOCUMENTS

| | | | | | |
|---|---|---|---|---|---|
| 5,952,789 | A | * | 9/1999 | Stewart et al. | 315/169.1 |
| 6,157,356 | A | * | 12/2000 | Troutman | 345/205 |
| 6,307,322 | B1 | * | 10/2001 | Dawson et al. | 315/169.1 |
| 2002/0030647 | A1 | * | 3/2002 | Hack et al. | 345/82 |
| 2002/0047839 | A1 | * | 4/2002 | Kasai | 345/211 |
| 2002/0050962 | A1 | * | 5/2002 | Kasai | 345/76 |

* cited by examiner

*Primary Examiner*—Don Wong
*Assistant Examiner*—Chuc Tran
(74) *Attorney, Agent, or Firm*—Epstein Drangel Bazerman & James, LLP; Joseph F. Murphy

(57) ABSTRACT

An active matrix OLED display includes current driving TFT transistors to provide current to corresponding OLEDs. The control signals to each TFT gate include a data signal that is proportional to the desired luminance output for the OLED and a reverse data signal that is used to reverse bias the TFT to prevent threshold drift in the TFT. The data signal alteration is preformed either at a frame rate or at a line rate.

11 Claims, 5 Drawing Sheets

METHOD AND SYSTEM FOR STABILIZING THIN FILM TRANSISTORS IN AMOLED DISPLAYS

FIELD OF THE INVENTION

The present invention is related to video display devices, and particularly to Active Matrix Organic Light Emitting Diode (AMOLED) display devices.

BACKGROUND

Recent advances in technology have made active matrix technology more attractive to employ in Organic Light Emitting Diode (OLED) video displays. Specifically, Thin Film Transistor (TFT) based active matrix displays provide the size and manufacturing cost efficiencies that are attractive to OLED video displays. In the conventional active matrix display, such as those employing Liquid Crystal Display elements (AMLCD), TFTs are used as driving elements to vary the orientation of the liquid crystals and thereby switch corresponding pixels off and on. In the case of OLEDs, active matrix technology allows efficient DC operation of each pixel, rather than row-by-row high frequency pulsed operation, as is required in passive matrix displays. For this reason, active matrix technology is expected to be widely used in OLED displays.

A complication associated with employing TFTs to drive OLEDs stems from the fact that TFTs become unstable when operating within the driving requirements of OLEDs. TFTs that are biased on for a long time suffer from a phenomena called "threshold drift." Threshold drift takes effect because when the TFT is on for a long period, electrons gain enough energy to allow them to leave the silicon and tunnel into the gate oxide. These trapped electrons in the oxide increase the threshold of NMOS devices. Corresponding hole processes can increase the negative threshold of PMOS devices. Eventually, such threshold variation makes the TFT unsuitable as a switching element. In the conventional AMLCD, the TFTs are biased on for a short time period, usually at the row rate of the display, because LCD elements do not need to continually receive current to properly operate. On the other hand, in the OLED display, the TFTs should be biased for a full duty cycle because the OLEDs require continuous current to properly operate. Accordingly, TFT threshold drift will be greater in the AMOLED devices. Therefore, there is a need for a method and system for stabilizing TFTs in AMOLED devices, reducing the effects of threshold drift.

SUMMARY OF THE INVENTION

In accordance with the invention, there is provided a method and system for stabilizing TFTs in AMOLED devices by driving each TFT gate with a signal that is alternating between two levels. In one embodiment, the driving of each TFT gate is by a two phase method. During a first phase, the TFT gate is provided with a data voltage signal. During a second phase, a reverse voltage level is provided to the TFT gate so as to reduce the effects of threshold drift.

In one embodiment, the invention provides a pixel driver circuit for driving an OLED pixel in an active matrix OLED display. The driver circuit includes a switch having an input, an output, and a control input which is coupled to a row select line of the display. The driver also includes a current driver TFT having a gate coupled to the output of the switch, a drain coupled to the pixel, and a source coupled to a voltage source. A capacitor has an electrode coupled to the voltage source and another electrode coupled to the current driver TFT gate. A toggle element has an output coupled to the input of the first switch. The toggle element has a first input and a second input. The first input is coupled to a data voltage input and the second input is coupled to a reverse voltage input. The toggle element is capable of alternating between inputs over a refresh period of the display.

The invention also provides a method for controlling a voltage controlled current driving TFT in an active matrix OLED display, which provides updated pixel data to each pixel of the display over a refresh period. The method includes providing a data signal to the current driving TFT gate during a first portion of the refresh period. The method also includes providing a reverse data signal to the current driving TFT gate during a second portion of the refresh period, where the reverse data signal negatively biases the TFT to reduce the effects of threshold drift.

DETAILED DESCRIPTION

Figure 1:
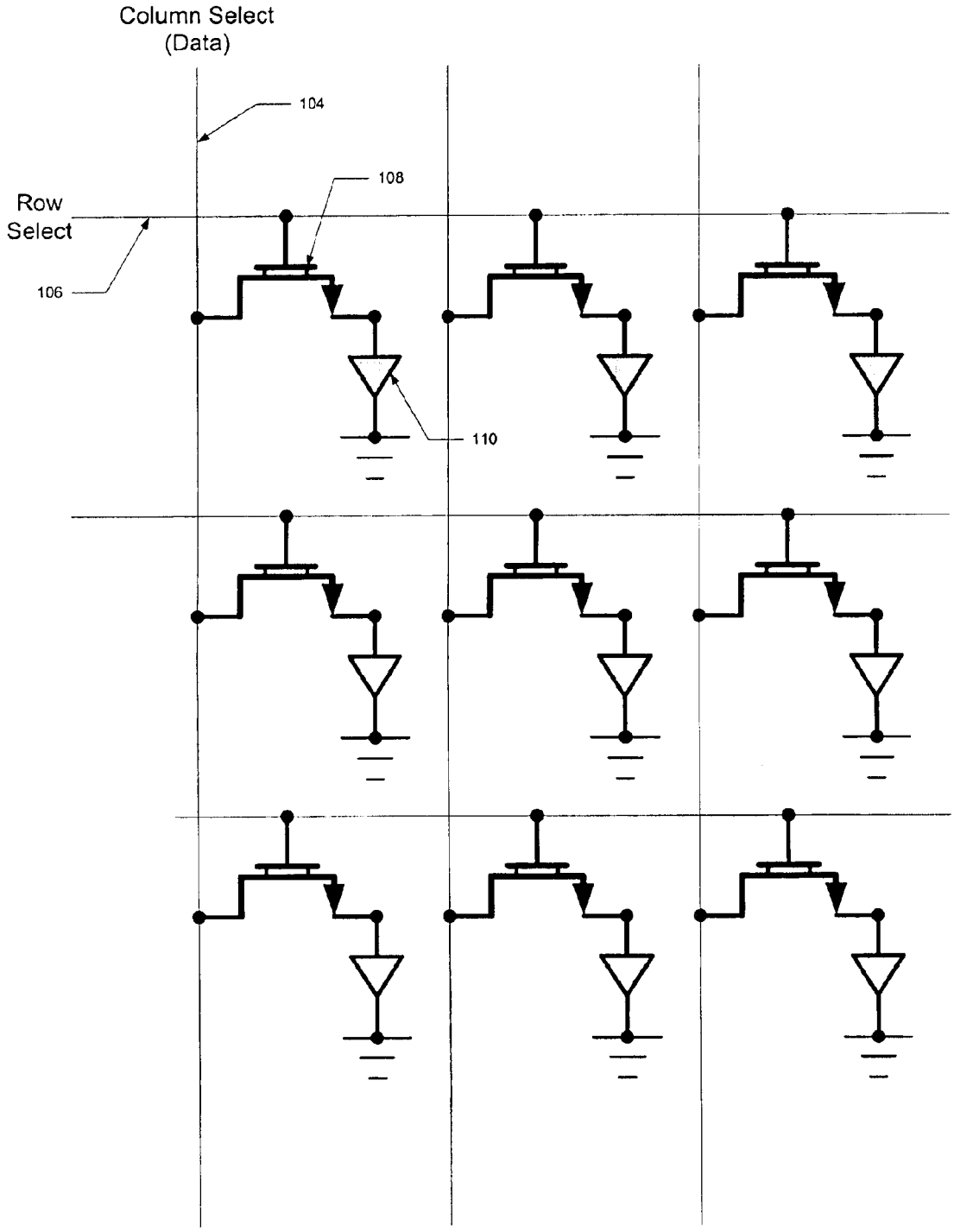
FIG. 1 illustrates a partial arrangement of TFTs and display elements in a conventional active matrix display configuration.

FIG. 1 illustrates an arrangement of TFT switching elements and OLED display elements, which follows conventional active matrix display architecture. In the conventional method, each display element 110 is associated with a corresponding TFT 108. In an AMLCD display, the display element is a liquid crystal cell. In FIG. 1, the display element is illustrated as a diode so as to provide an example operation of the display when driving OLEDs in the conventional manner. As may be appreciated, in FIG. 1, each OLED corresponds to a pixel of the display. In other embodiments, a group of OLEDs forms one pixel element, whereby each OLED provides a different color to the pixel element. The gate of the TFT 108 is coupled to a row select line 106. The source of the TFT 108 is coupled to a column data line 104, which provides data signals to the TFT 108.

In operation, the row select line 106 provides a signal to switch on each TFT 108 once during each refresh period of the display. Accordingly, each row is selected for a period equal to the refresh period divided by the number of rows. The column data line 104 provides column data to the source of each TFT 108 in the selected row, so that each OLED is ON for a fraction of a frame, 1/N, where N is the number of rows. As may be appreciated, the data on each column data line 104 is preferably different between rows for every row selection to provide a corresponding data value to the TFT 108 in the selected row. Preferably, the data values that are used to drive the column data lines 104 are stored in a buffer memory which includes a storage element corresponding to each pixel in the display. When the pixel's row is selected, the corresponding column data value is extracted from the buffer and is used to set the appropriate column data line voltage or current.

When OLEDs are used as the display elements, as in the illustrated arrangement, it is advantageous to bias ON the TFT 108 for the full duty cycle, because the OLED 110 only generates light when current is flowing through the device. Accordingly, a storage element (not shown) is generally added to the TFT to provide the data voltage for the duration of the refresh period. However, biasing the TFT 108 on for a full duty cycle increases the effects of threshold drift. Over time, the effects of the drift will make the TFT 108 unacceptable for use as a switching element, as discussed above.

Figure 2A:
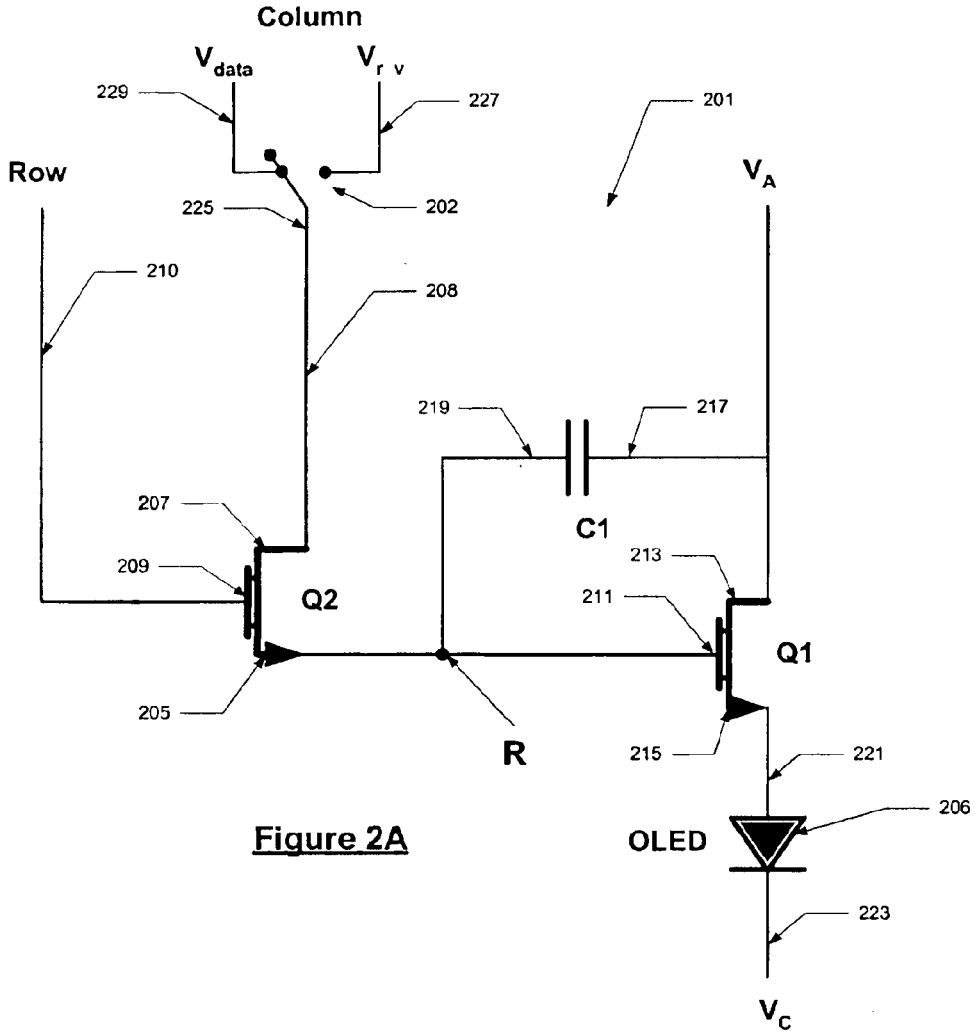
FIG. 2A illustrates a voltage controlled OLED driver circuit in accordance with the invention.

FIG. 2A illustrates a driver circuit 201 in accordance with the invention, which reduces the effects of TFT threshold drift. The driver circuit of FIG. 2A, along with the corresponding control line configuration, is adapted to replace the TFT driver 108 in the conventional active matrix configuration, which is illustrated in FIG. 1. Additionally, the image data sequence, which supplies corresponding signals to the row select line and to the column data line, is modified in accordance with the invention. The image data sequence is illustrated below with reference to FIGS. 4 and 5. In one embodiment, the sequence includes two phases. During a first phase, image data is provided to the pixel current driver. During a second phase, the pixel current driver is biased off with a strong positive bias, which reduces the effects of threshold drift. In one embodiment, each phase is during half of the frame time. Accordingly, in this embodiment, the net effect at the pixel level is that each pixel is ON during half of the frame time, which is an improvement over other methods where each pixel is ON during every 1/N of the frame time.

The driver circuit 201 includes a first transistor (current driver) Q1 and a second transistor Q2, each having a source, a drain, and a gate. Preferably, the first transistor Q1 and the second transistor Q2 are TFT devices. The driver circuit 201 also includes a capacitor C1 and an OLED 206. Outside the driver circuit, a toggle element 202 is coupled to the column data line of the display 210. The OLED cathode 223 is coupled to a voltage source Vc, where Vc is at a level that is sufficient to bias the OLED to its turn-on voltage. The voltage source Vc preferably provides between −3 and −5 Volts to the OLED cathode 223. The OLED anode 221 is coupled to the current driver drain 215. The current driver source 213 is coupled to a voltage source Va. The voltage source Va preferably provides the current that is used to drive the OLED 206.

A first capacitor electrode 217 is coupled to the current driver source 213 and to the voltage source Va. A second capacitor electrode 219 is coupled to the current driver gate 211 and to the second transistor drain 205. The capacitor C1 preferably functions as a storage element to hold a charge, which is proportional to the signal provided on the column data line 208.

The second transistor drain 205 is coupled to the current driver gate 211. The second transistor gate 209 is coupled to the row select line 210. The second transistor source 207 is coupled to the column data line 208. The toggle element 202 has a first input 229 coupled to a data voltage source and a second input 227 coupled to a reverse data source, i.e., a voltage opposite of the data voltage. The toggle element output 225 is coupled to the column data line 208. The display preferably further includes a control line (not shown) that is used to transmit control signals to the toggle element 202 so as to select an input from between the two inputs 229, 227 provided to the toggle element. In one embodiment, the control signals to the toggle element 202 are provided by a display integrated control logic (not shown).

In operation, during a first phase of operation, the toggle element 202 is controlled to provide the data voltage input 229 to the column data line 208. The data signal is preferably a constant voltage signal that is appropriate for the desired pixel luminance value. The driver circuit 201 preferably stores a voltage level that allows for maintaining a proportional current through the OLED until the beginning of the reverse voltage cycle. Accordingly, when the row select line 210 is set to bias ON the second transistor Q2, the capacitor C1 is charged by the column data line current that is flowing through the second transistor Q2. The capacitor C1 is preferably charged to store a desired voltage level for the current driver gate 211 according to the input data.

During a second phase, the toggle element 202 provides the reverse data input 227 to the column data line 208. The row select line is maintained at the same level as during the first phase to bias ON the second transistor Q2. The reverse voltage produces a change in voltage at point R of the circuit of FIG. 2A. The capacitor C1 charges to the new voltage (a positive potential in the illustration). After the capacitor C1 reaches the new voltage level, the current driver Q1 is reverse biased since the voltage at the current driver gate 211 is opposite the voltage during the first phase. The reverse bias compensates for the drift in TFT threshold that may result from the forward bias previously provided to the current driver Q1. The reverse bias induces an extraction of the charge, which was injected into the insulator, causing a threshold drift. Preferably, during the second phase, current is not provided to the OLED.

Figure 2B:
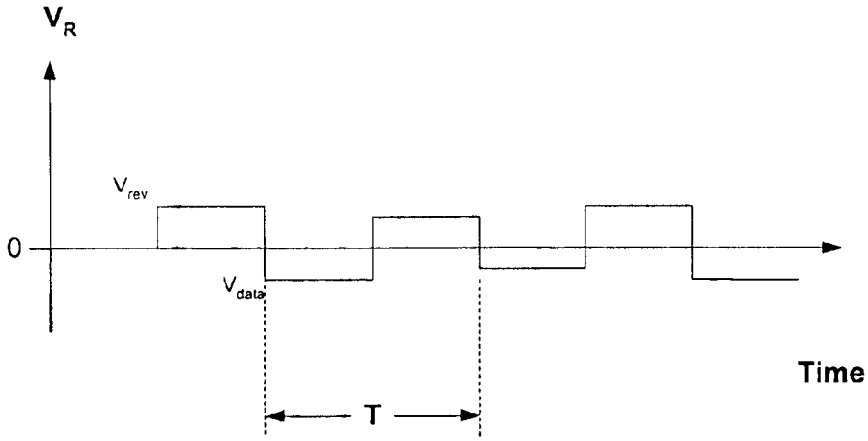
FIG. 2B is a chart illustrating the voltage at the gate of the current driving TFT in the circuit of FIG. 2A.

FIG. 2B illustrates the voltage level at point R, which is also the voltage at the pixel output transistor gate 211, during several refresh periods. As may be appreciated, in this embodiment, the voltage levels at the pixel output transistor gate 211 vary between the data voltage and the reverse data during each pixel refresh period (T), which consists of an even number data frame and an odd number reverse bias frame.

In one embodiment, the reverse data level is selected by reference to the data voltage level for each pixel. Accordingly, in this embodiment, a high level data signal results in a high level reverse data signal applied to the current driver TFT Q1. Preferably, a frame buffer is used in the display, in addition to a pixel data frame buffer, to store the reverse data levels for half the pixels. As may be appreciated, the half frame buffer is updated during the display refresh period to replace reverse data values with new reverse data values as reverse data is delivered to pixels. In another embodiment, where the display is used to provide images that include substantially uniform pixel levels, which do not vary greatly between pixels, such as in a video display, a predetermined reverse data signal is used for all pixels. In this embodiment, the reverse data value is preferably derived from the average data signal level available to the display.

Figure 3A:
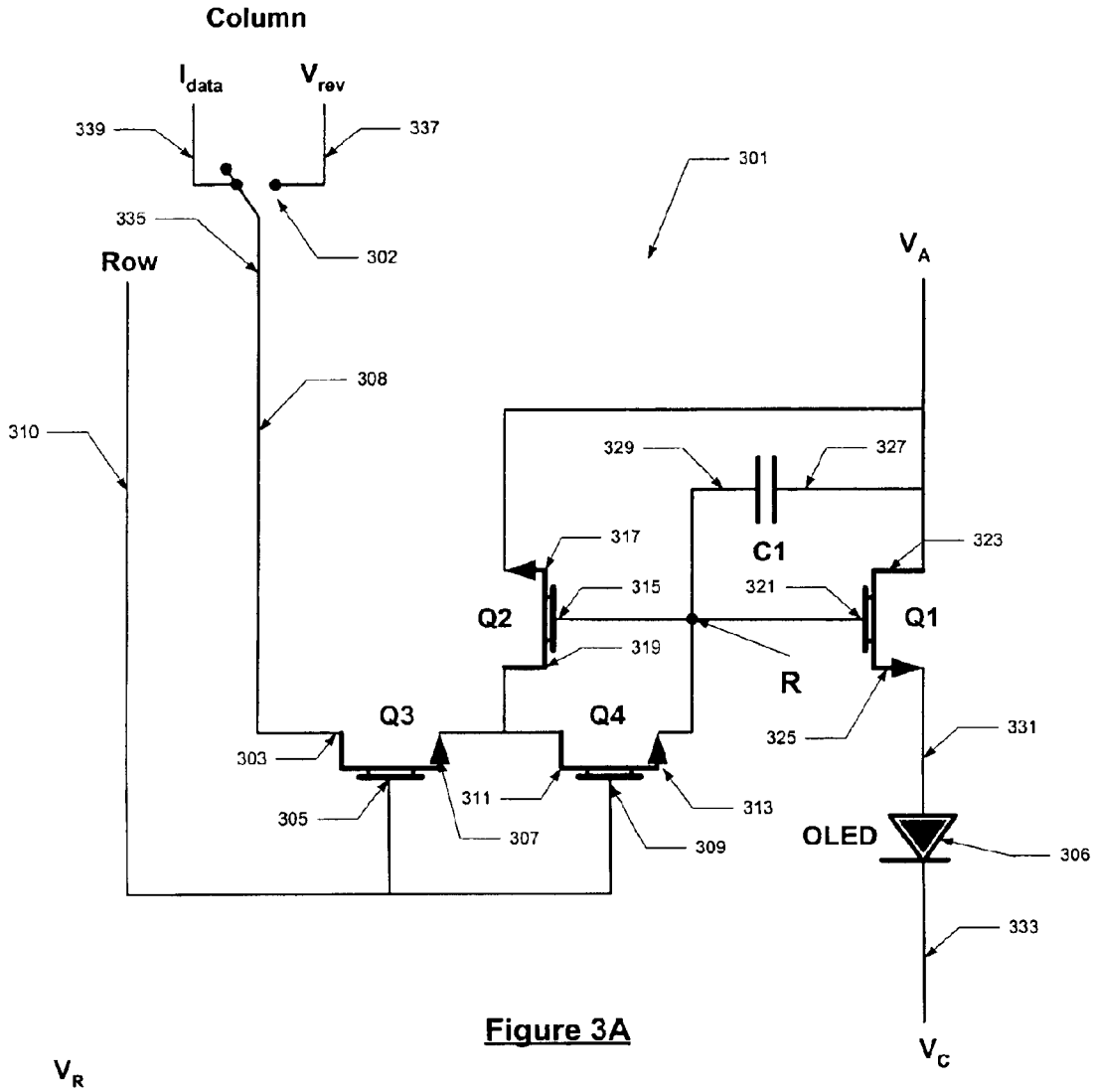
FIG. 3A illustrates a current controlled OLED driver circuit in accordance with the invention.

FIG. 3A illustrates a data current driven embodiment of the driver circuit of FIG. 2A. The data provided to the circuit of FIG. 3A is preferably varied by current levels as opposed to voltage levels (as in FIG. 2A). As may be appreciated from FIG. 3B, the resultant voltage levels at the gate of the current driver TFT Q1 of FIG. 3A are substantially the same as the voltage levels at the gate of the current driver TFT Q1 of FIG. 2A.

The circuit 301 of FIG. 3A includes a current driver TFT Q1, a second transistor Q2, a third transistor Q3, a fourth transistor Q4, a capacitor C1, a toggle element 302, and an OLED 306. Each transistor Q1, Q2, Q3, and Q4, preferably includes a gate, a source, and a drain. The OLED cathode 333 is coupled to a voltage source Vc. The voltage source Vc preferably provides between −3 and −5 Volts to the OLED cathode 333. The OLED anode 331 is coupled to the current driver drain 325. The current driver source 323 is coupled to a voltage source Va. The voltage source Va preferably provides the current supply for driving the OLED 306.

A first capacitor electrode 327 is coupled to the current driver source 323. A second capacitor electrode 329 is coupled to the current driver gate 321. The second transistor gate 315 is coupled to the current driver gate 321. The second transistor drain 317 is coupled to the voltage source Va. The second transistor source 319 is coupled to the third transistor drain 307 and to the fourth transistor source 311. The third transistor gate 305 and the fourth transistor gate 309 are both coupled to the row select line 310. The third transistor source 303 is coupled to the column data line 308. The fourth transistor drain 313 is coupled to the current driver gate 321. The toggle element 302 has a first input 339 coupled to data current source and a second input 337 coupled to reverse data source. The toggle element output 335 is coupled to the column data line 308.

In operation, a refresh period starts when the row select line switches on the third transistor Q3 and the fourth transistor Q4 to allow current to flow from the column data line 308. In this embodiment, at the start of the refresh period, the data current input 339 is provided by the toggle element output 335 to the column data line 308. The current flow from the column data line 308 charges the capacitor C1 according to the input data current level. After the capacitor C1 is charged, the current driver Q1 is biased on to provide output current in accordance with the voltage level at its gate 321. As may be appreciated, the current to the OLED 306 is proportional to the voltage at the pixel output transistor gate 321, which is point R.

During a second phase, the toggle element 302 provides the reverse data input 337 to the column data line 308. After the capacitor C1 is charged to the level that results from the reverse data level, the TFT current driver Q1 is biased off. The reverse bias to the TFT current driver Q1 reduces the effects of threshold drift, which may result from the forward bias during the first phase.

Figure 3B:
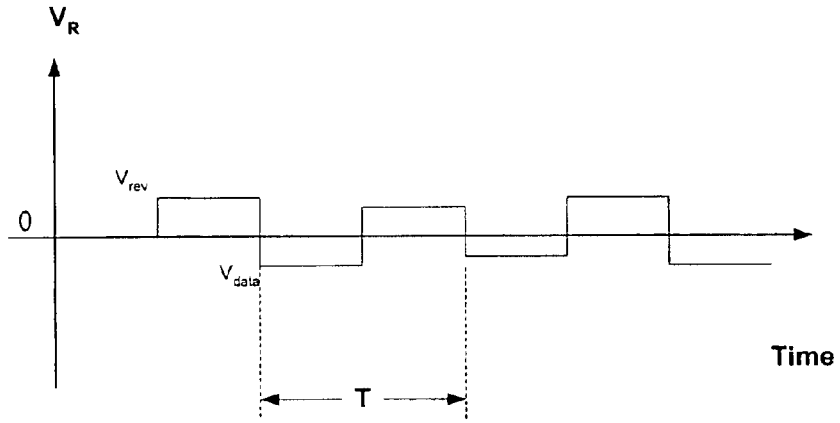
FIG. 3B is a chart illustrating the voltage at the gate of the current driving TFT in the circuit of FIG. 3A.

FIG. 3B illustrates the voltage level at the current driver gate, point R, over several cycles of providing display data to the OLED. As may be appreciated, the voltage levels at the current driver gate 321 vary between the reverse voltage and the data voltage during each refresh period (T). The reverse voltage in the embodiment of FIG. 3A is determined either by reference to the data current signal or by reference to an average data signal level, as discussed above with reference to FIG. 2B.

Figure 4:
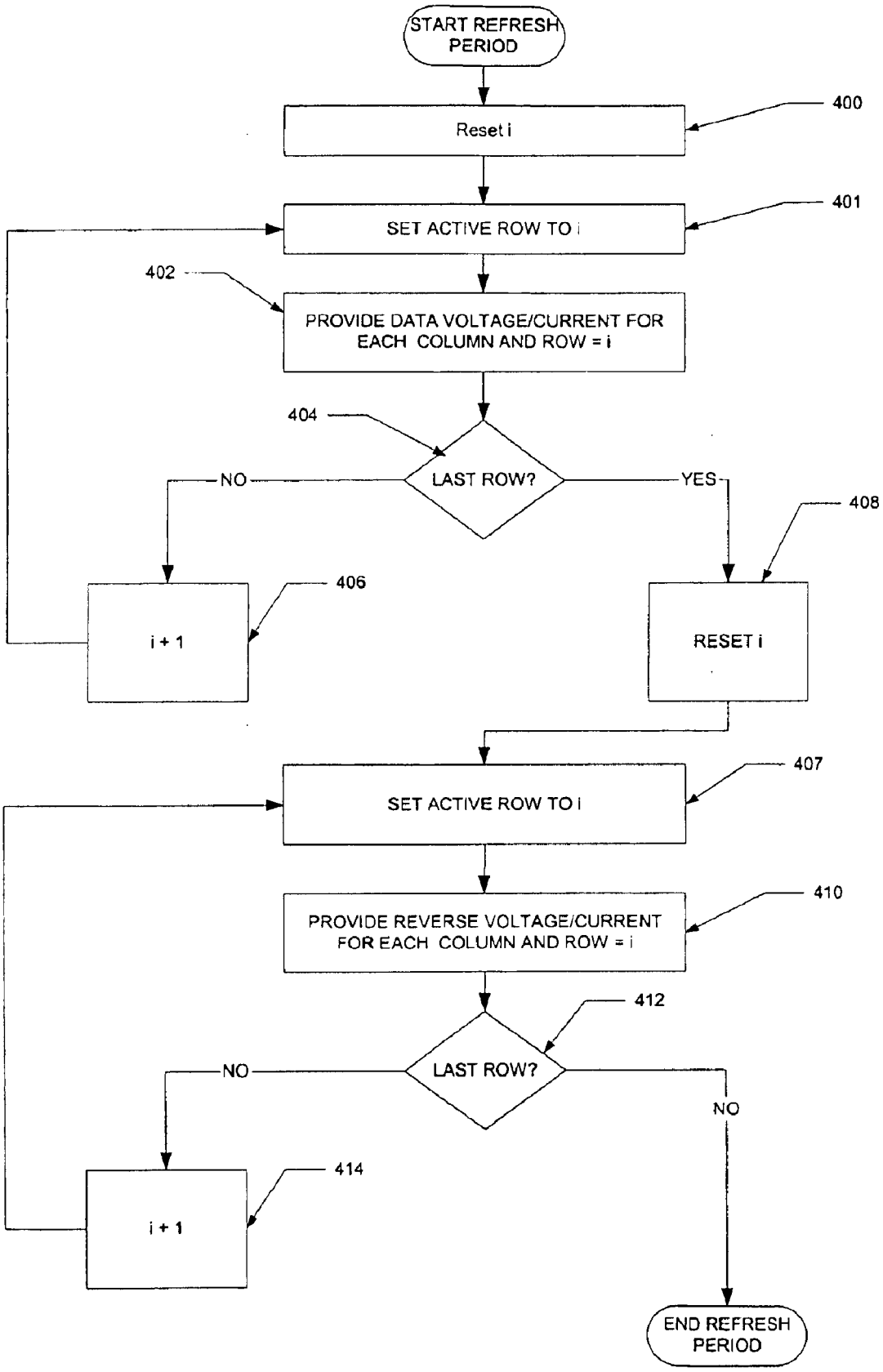
FIG. 4 is a flow diagram illustrating a method for providing control signals to OLED driver circuits in accordance with the invention.
Figure 5:
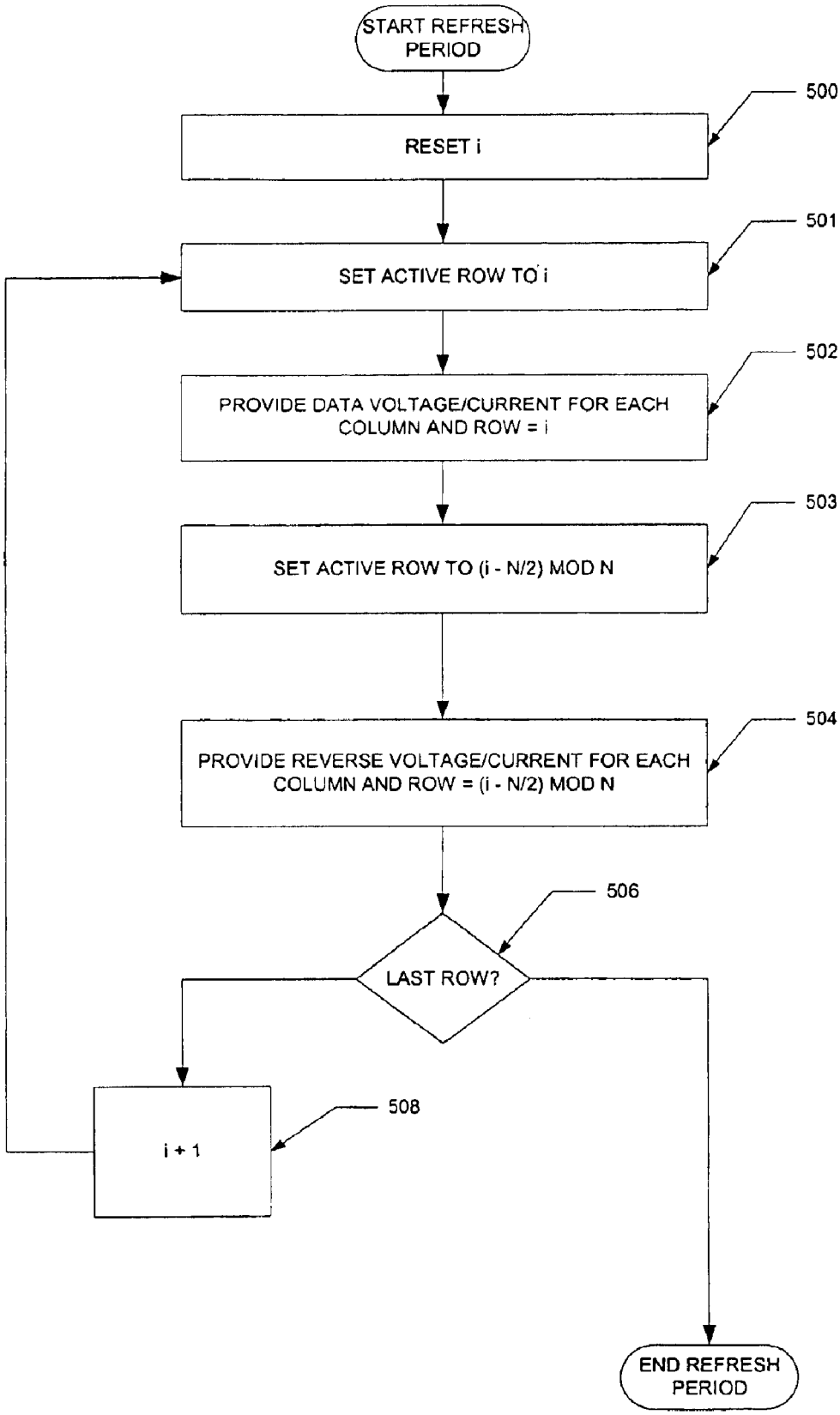
FIG. 5 is a flow diagram illustrating an alternate method for providing control signals to OLED driver circuits in accordance with the invention.

FIG. 4 is a flow diagram illustrating a first method for providing signals to driver circuits in accordance with the embodiments illustrated in FIGS. 2A and 3A. FIG. 5 illustrates a second method for providing signals to driver circuits in accordance with the same embodiments. The illustrated methods are preferably implemented by control logic in the integrated circuit portion of the display device. Although the discussion below refers to a display as performing the illustrated control functions, the functions are likely implemented in various internal and external logical and physical elements. These logic elements are not illustrated but would be apparent to one skilled in the art when implementing the logical flow that is illustrated in FIGS. 4 and 5.

Referring now to FIG. 4, the display initializes a row counter ("i") at the start of each refresh period (Step 400), to set the value of the row counter to 1. The display sets the active row to the current value of the row counter and provides an active signal on the corresponding row select line (Step 401). The data signal for each pixel in the row is then provided on the column data lines of the display (Step 402). The data is preferably stored in a frame buffer, as discussed above. The data is preferably provided to the column data line by the toggle element on each line selecting to provide the data voltage or current to the corresponding column data line. The display determines if the row counter value is the last row of the display (Step 404).

If the row counter value is not the last row of the display, the row counter is increased by one row (Step 406) and the display returns to Step 401, where the active row is set to the row counter value. If the row counter value is the last row of the display, the display moves on to reset the row counter to the first row of the display (Step 408). The display sets the active row to the current value of the row counter and provides an active signal on the corresponding row select line (Step 409). Reverse data is provided to the column data lines of the selected row by the toggle element selecting to provide the reverse data to the corresponding column data line. The reverse data level is preferably set with reference to the data level on the corresponding signal or as a uniform level, as discussed above. The display determines if the row counter value is the last row of the display (Step 412). If the row counter value is not the last row of the display, the row counter is increased by one (Step 414) and the display moves on to Step 409 where the active row is set to the row counter value. If the row counter is the last row of the display, the refresh period is complete.

FIG. 5 illustrates an alternate method for providing control data to the driver circuit where line rate alternation is employed to provide data signals and reverse data to sequential rows of the display. The display starts the refresh period by setting the row counter ("i") to the first row of the display (Step 500). The active row is set according to the row counter value (Step 501). The data signal for each pixel in the row is provided on the column data lines of the display (Step 502). The active row is moved to the result of the Modula operation of the difference between the row counter and half of the number of rows against the number of rows in the display (Step 503). Reverse data is provided to the column data lines for the resultant active row (Step 504). The display determines if the row counter value is the last row of the display (Step 506). If the row counter value is not the last row of the display, the row counter is increased by one row (Step 508) and the display returns to Step 501 where the active row is set to the row counter value.

Although the present invention was discussed in terms of certain preferred embodiments, the invention is not limited to such embodiments. Rather, the invention includes other embodiments including those apparent to a person of ordinary skill in the art. Thus, the scope of the invention should not be limited by the preceding description but should be ascertained by reference to the claims that follow.

What is claimed is:

1. A pixel driver circuit for driving an OLED pixel in an active matrix OLED display, comprising:

a switch having an input, an output, and a control input which is coupled to a row select line of the display;

a current driver TFT transistor having a gate coupled to the output of the switch, a drain coupled to the pixel, and a source coupled to a voltage source;

a capacitor having an electrode coupled to the voltage source, and another electrode coupled to the current driver TFT transistor gate; and a toggle element having a first input, a second input, and an output, the output being coupled to the input of the switch and including a first toggle input and a second toggle input, the first toggle input being coupled to a data voltage and the second input being coupled to a reverse voltage, the toggle element alternately switching the output coupled to the input of the switch between the first toggle input and the second toggle input over a refresh period of the display.

2. A method for providing data to pixel drivers in an active matrix OLED display employing voltage controlled TFT current drivers, the display including row control lines activating select rows of the display and column data lines to provide data to pixels in selected rows, the method comprising:

a. activating a row of the display by transmitting a corresponding control signal to the row control in for the row;

b. providing data signals to the column data lines of the display in accordance with the display pixel data for the row;

c. repeating steps (a) and (b) until data is provided to all rows of the display;

d. activating a row of the display by transmitting a corresponding control signal to the row control line of the row;

e. providing reverse data signals to the column data lines of the display, the reverse data determined by reference to the data signals levels provided to the rows of the display; and f. repeating steps (d) and (e) until reverse data is provided to all rows of the display.

3. The method of claim 2, wherein the reverse data signal is derived from each pixel data signal provided in step (b).

4. A method for providing data to pixel drivers in an active matrix OLED display employing voltage controlled TFT current drivers, the display including a row control line activating each row of the display an column data lines to provide data to columns of the display, the method comprising:

a. activating a first row of the display by transmitting a corresponding control signal to the row control line for the first row;

b. providing data signals to the column data lines of the display in accordance with the display pixel data for the first row;

c. activating a second row of the display by transmitting a corresponding control signal to the row control line of the second row;

d. providing reverse data signals to the column data lines of the display in accordance with the reverse data for the second row;

e. repeating steps (a)–(d) until each row of the display is provided a data signal and is provided a reverse data signal.

5. The method of claim 4, wherein the second row is determined by the formula:

$$\text{Row}=(\text{Current row}-N/2)\text{Mod } N; 1\leq\text{Row}\leq N$$

Where N is the number of rows in the display.

6. The method of claim 4, wherein the reverse data signals provided to a row are derived from the data signals provided to each pixel in the row.

7. The method of claim 4, wherein the reverse data signals are a predetermined level signal uniformly provided to all rows of the display.

8. A pixel driving circuit, comprising:

a current switch having a control input, a current input, and a current output;

a storage element coupled to the current output of the switch to receive data current from the switch;

a current driving transistor, the current driving transistor having a gate coupled to the output of the storage element, and having an output coupled to a pixel; and a toggle switch having a first input coupled to a data source and having a second input coupled to a reverse data source and having an output coupled to the current input of the current switch.

9. An OLED active matrix display, comprising:

a plurality of pixel elements arrange as a matrix, said matrix arrangement including pixel rows and pixel columns;

a plurality of row control lines for selectively activating a row of pixel elements so as to update pixel data in said pixel elements;

a plurality of column control lines for providing data to activate each pixel elements in a selected row;

a toggle selection element means selecting between at least a first input and a second input to provide an output, each selection means output operatively coupled to one of said plurality of column control lines;

means for providing pixel data, said means for providing pixel data coupled to slid first input of each of said plurality of selection means; and means for providing reverse pixel data, said means for providing reverse pixel data coupled to said second input of each of said plurality of selection means.

10. The display of claim 9, wherein the pixel elements are TFT based current driving circuits.

11. The display of claim 9, wherein each pixel element includes a plurality of OLED display elements.

* * * * *